United States Patent [19]

Sato et al.

[11] Patent Number: 4,613,285

[45] Date of Patent: Sep. 23, 1986

[54] PISTON STROKE CONTROL DEVICE FOR FREE PISTON TYPE OSCILLATING COMPRESSORS

[75] Inventors: Eiji Sato; Tamio Fukuda; Masaharu Ishii; Mitsuru Nakamura; Yozo Nakamura, all of Ibaraki, Japan

[73] Assignee: Hitachi, Ltd., Tokyo, Japan

[21] Appl. No.: 719,146

[22] Filed: Apr. 2, 1985

[30] Foreign Application Priority Data

Apr. 2, 1984 [JP] Japan ..... 59-63306

[51] Int. Cl.[4] ..... F04B 25/02; F04B 49/00; F01B 31/00

[52] U.S. Cl. ..... 417/214; 417/216; 417/418; 417/254; 92/131

[58] Field of Search ..... 417/212, 214, 216, 418, 417/275-277, 244, 246, 254, 257, 265; 92/134, 131, 130 C

[56] References Cited

U.S. PATENT DOCUMENTS

| | | | |
|---|---|---|---|
| 674,979 | 5/1901 | McLean | 417/214 X |
| 3,183,840 | 5/1965 | Conover | 417/216 |
| 3,249,053 | 5/1966 | Govan | 417/216 X |
| 3,437,044 | 4/1969 | Sandes et al. | 417/418 |
| 3,531,065 | 9/1970 | Brown | 92/134 X |
| 3,937,600 | 2/1976 | White | 417/418 |
| 4,033,233 | 7/1977 | Toi | 92/131 X |
| 4,067,667 | 1/1978 | White | 417/418 |
| 4,353,220 | 10/1982 | Curwen et al. | 417/214 X |

FOREIGN PATENT DOCUMENTS

| | | | |
|---|---|---|---|
| 509579 | 8/1952 | Belgium | 417/418 |
| 785748 | 6/1960 | France | 417/418 |

*Primary Examiner*—Carlton R. Croyle
*Assistant Examiner*—Theodore W. Olds
*Attorney, Agent, or Firm*—Antonelli, Terry & Wands

[57] ABSTRACT

In a free piston type oscillating compressor, closed spaces separate from gas springs are provided, and pressures of the closed spaces are regulated, whereby the amplitude, and central position of the stroke, of a free piston can be precisely controlled.

10 Claims, 7 Drawing Figures

PISTON STROKE CONTROL DEVICE FOR FREE PISTON TYPE OSCILLATING COMPRESSORS

BACKGROUND OF THE INVENTION

1. Field of the Invention

The present invention relates to a piston stroke control device which is well suited to control the central position and the amplitude of the stroke of a free piston in a free piston type oscillating compressor.

2. Description of the Prior Art

Stroke control devices for free piston type oscillating compressors have been known from U.S. Pat. Nos. 3,937,600 and 4,067,667. The prior-art devices are so constructed that the diameters of compression pistons are equal on both sides, and the suction pressure and discharge pressure of compression chambers are also equal on both sides. The mean pressure of the gas springs is considered equal on both sides. In practice, however, the mean pressure in compression chambers and gas spring chambers is not exactly the same because of non-uniform piston seals. Accordingly, the central position of the stroke of the free piston deviates somewhat to either side. When the piston seals are conspicuously non-uniform, the free piston deviates extremely so as to render the operation of the device impossible. Regarding the amplitude of the free piston stroke, the amplitude of the alternating component of the piston stroke and the current of a linear motor are detected, and the mean pressure in the gas spring chambers is regulated on the basis of the phase difference between the amplitude of the piston stroke and the current of the linear motor so as to control the piston stroke. Except for a resonant point, the gas springs have two spring constants for the same amplitude. When controlling the piston amplitude, therefore, it must be controlled either in a region greater than or smaller than the resonant point. In the prior art, the phase difference between the piston amplitude and the current of the linear motor at the resonant point is used as reference. Since, however, the phase difference at the resonant point changes depending upon the piston amplitude, the operation of the compressor in the vicinity of the resonant point is impossible when the phase difference is taken as the reference.

SUMMARY OF THE INVENTION

An object of the present invention is to provide a piston stroke control device which controls the central position and the amplitude of the stroke of a piston in a free piston type oscillating compressor so as to operate the compressor most efficiently.

Another object of the present invention is to provide a stroke control device which can precisely control the central position and the amplitude of the stroke of a free piston in a free piston type oscillating compressor.

In order to accomplish these objects, the present invention disposes new spaces sealed from gas spring chambers and regulates the pressures of these spaces, whereby the central position of piston stroke can be controlled without affecting the spring constants of the gas springs.

The resonant spring constant of the free piston is determined by the mean pressure in the gas spring chambers and compression chambers. Since, however, the spring effect of the compression chambers is much smaller than that of the gas springs, the resonant spring constant is substantially determined by the mean pressure in the gas spring chambers. Accordingly, when the mean pressure in the gas spring chambers is taken as the reference for amplitude control, the operation of a compressor in the vicinity of a resonant point is possible without being affected by the piston amplitude.

PREFERRED EMBODIMENT OF THE INVENTION

Figure 1:
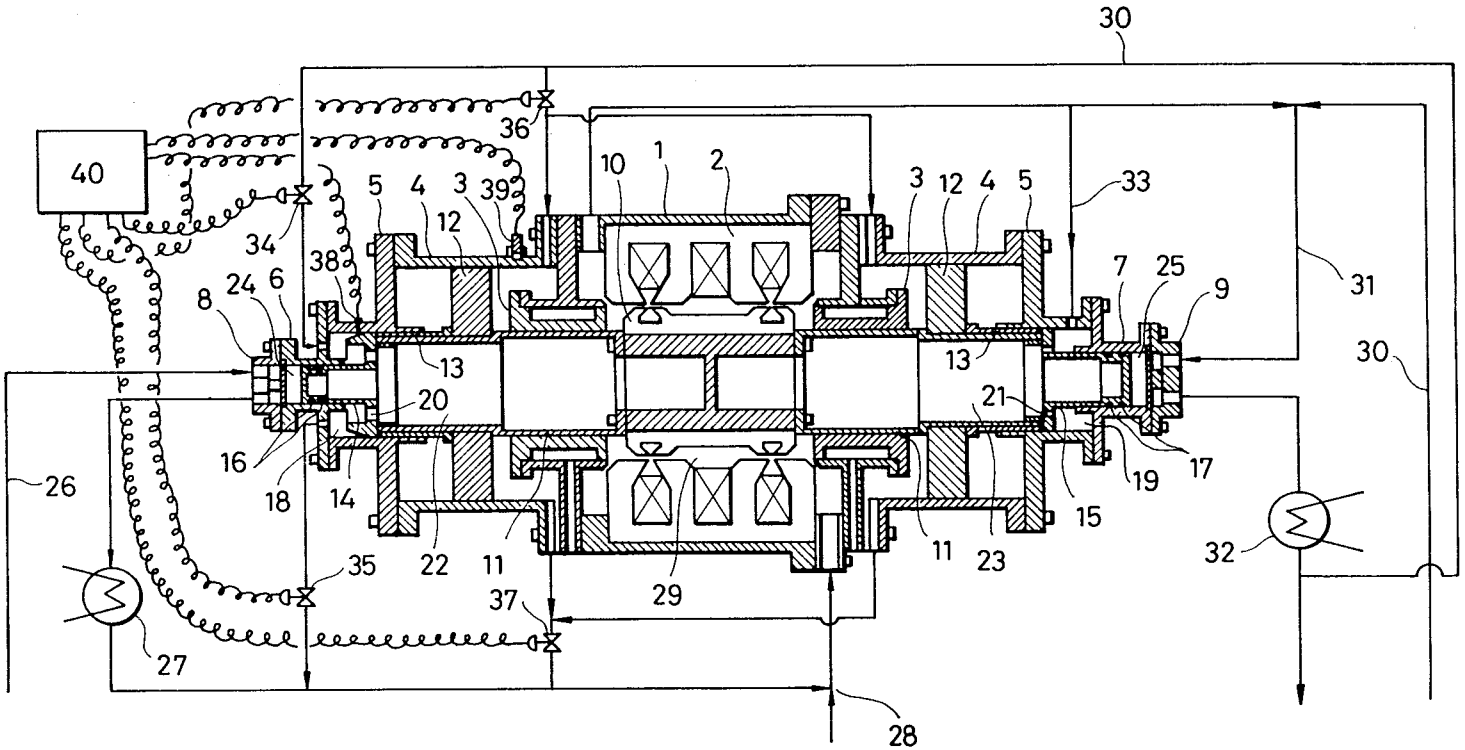
FIG. 1 is a sectional view of a free piston type oscillating compressor.

A motor housing 1 accommodates therein the stator 2 of a linear motor, on both the sides of which are mounted bearings 3, cylinders 4 for gas springs, flanges 5 for the gas springs, cylinders 6, 7 for compression, and cylinder heads 8, 9. A free piston has shafts 11, pistons 12 for the gas springs, sleeves 13, and pistons 14, 15 for compression mounted on both the sides of the plunger 10 of the linear motor In FIG. 1, the reciprocating motion seal parts provide the clearances between the compressing pistons 14, 15 and cylinders 6, 7, the clearances between the gas spring pistons 12 and cylinders 4, the clearances between the shafts 11 and the bearings 3, and the clearances between the gas spring flanges 5 and sleeves 13. The clearances between the compressing pistons 14, 15 and cylinders 6, 7 are sealed by disposing piston rings 16, 17, and the other clearances may also the provided with sealing means. Pressure spaces 18, 19 for controlling the central position of the stroke of the free piston are arranged between compression chambers and gas spring chambers, but the effect of the present invention is similarly attained even when the pressure spaces are arranged between the gas spring chambers and the bearings or between the bearings and the linear motor. The flanges of the compression pistons 14, 15 are respectively formed with openings 20, 21 to bring interspaces 22, 23 within the free piston and the pressure spaces 18, 19 into communication, so that the pressure of the pressure spaces 18, 19 hardly changes even when the free piston oscillates. By regulating the pressure of the pressure spaces 18, 19, accordingly, the central position of the stroke of the free piston can be controlled without affecting the spring constants of the gas springs.

The free piston type oscillating compressor described above can be used as a conventional single-stage compressor by equalizing the diameters of the cylinders 6, 7 for compression and coupling the suction ports and the discharge ports of the compression chambers on both the sides by means of pipes. It can be used as an ordinary two-stage compressor by setting the compression chamber 25 as a lower pressure stage and feeding a gas compressed here into the compression chamber 24. It can be used as a compressor for a cryogenic refrigerator by setting the compression chamber 24 as a lower pressure stage and the compression chamber 25 as a higher pressure stage. The imbalance between the mean pressures in the compression chambers on both sides and the gas spring chambers on both sides is small in the conventional single-stage compressor, but it is very great in special applications such as the cryogenic refrigerator. Here, a free piston type oscillating compressor in which the imbalance force is great will be described with reference to FIG. 1.

When the linear motor is supplied with power, the plunger 10 is oscillated laterally at the supply frequency. When the natural frequency of a mechanical oscillation system formed of the free piston and the gas springs is equal to the supply frequency, the free piston into a nearly resonant state in which the amplitude of the free piston is maximized even with an identical oscillating force. When the free piston reciprocates under such condition, the gas passes through a suction pipe 26, it is sucked into and discharged from the lower pressure stage compression chamber 24; it is then cooled in an intercooler 27, and it joins the gas from a pipe 28. The resultant gas passes through the interior 29 of the linear motor housing, to cool the motor, and it passes through a suction pipe 31, it is sucked into and discharged from the higher pressure stage compression chamber 25; it is cooled in an aftercooler 32, and it flows to a cryogenic refrigeration cycle.

The compression chamber 24 is smaller in diameter and at a lower mean pressure than the compression chamber 25, so that the free piston deviates leftwards. Here, the suction pressure of the higher pressure stage compression chamber is fed into the pressure space 19 by a pipe 33. The pressure space 18 has a high pressure gas fed thereinto through a flow control valve 34 or conversely, discharged therefrom to a low pressure source through a flow control valve 35, whereby the pressure of the pressure space 18 can be regulated within a range between the suction pressure and the discharge pressure of the higher pressure stage compression chamber. The inner diameter of the pressure space 18 must therefore be enough to cancel the gaseous force urging the free piston leftwards, in consideration of the pressure regulation range as mentioned above. Since the clearance between the flange 5 and sleeve 13 for the gas spring can be formed so as to have sufficient sealing property, the pressure of the pressure space 18 can be regulated by the flow control valves 34, 35 without affecting the spring constant of the gas spring.

The mean pressure in the gas spring chambers can be regulated by feeding the high pressure gas into the gas spring chambers through a flow control valve 36 or discharging the gas in the gas spring chambers to the low pressure source through a flow control valve 37. When the mean pressure in the gas spring chambers is raised, the spring constants increase, and when the former is lowered, the latter decreases.

The pressure in the pressure space 18 and the mean pressure in the gas spring chambers are regulated by a controller 40 on the basis of the output signal from a gap sensor 38 for the free piston and the output signal from a pressure transducer 39 fixed in the gas spring chamber. The pressure in the gas spring chamber is exerted on the pressure transducer 39 through an orifice, whereby the mean pressure in the gas spring chambers can be measured.

Figure 2:
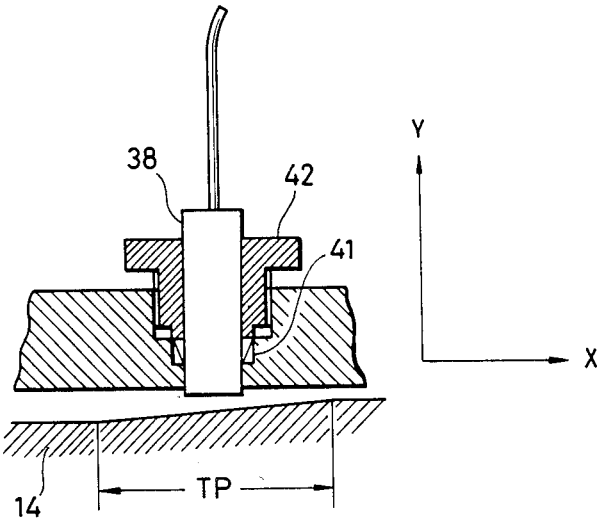
FIG. 2 is a sectional view of a portion for detecting the position of a free piston.
Figure 3:
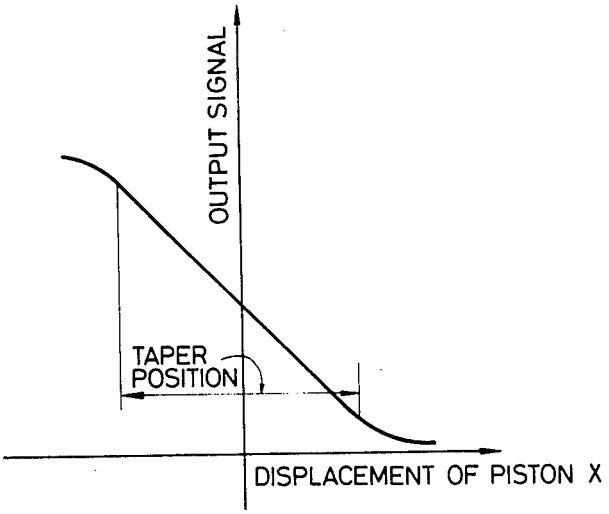
FIG. 3 is a graph showing the relationship between the position of the free piston and the output signal of a gap sensor.

The position of the free piston relative to the cylinder can be detected by a method illustrated in FIG. 2. The gap sensor 38 is fixed by a seal ring 41 and a plug 42. The gap sensor 38 is one which is generally commercially available, and it measures displacement along the Y-axis. Since the free piston 14 is supported by bearings it scarcely moves along the Y-axis. However, when the free piston 14 is provided with a tapered portion TP, a gap in the Y-axial direction changes as the free piston moves along the X-axis, and hence, the position of the free piston can be detected. Since the X-axial displacement of the free piston and the gap in the Y-axial direction are proportional, the output signal from the gap sensor versus the X-axial displacement of the piston is as shown in FIG. 3. As seen from FIG. 3, the X-axial displacement and the output signal are in a proportional relation to the taper portion, but this proportional relation does not hold between the X-axial displacement and the output signal in the vicinity of the boundary between the tapered portion and a portion parallel to the center axis of the plunger 10. Thus, when the length of the tapered portion is set so as to be substantially equal to the stroke of the free piston, the output signal is proportional to the displacement of the free piston, so that the accuracy of control of the piston stroke can be enhanced.

Figure 4:
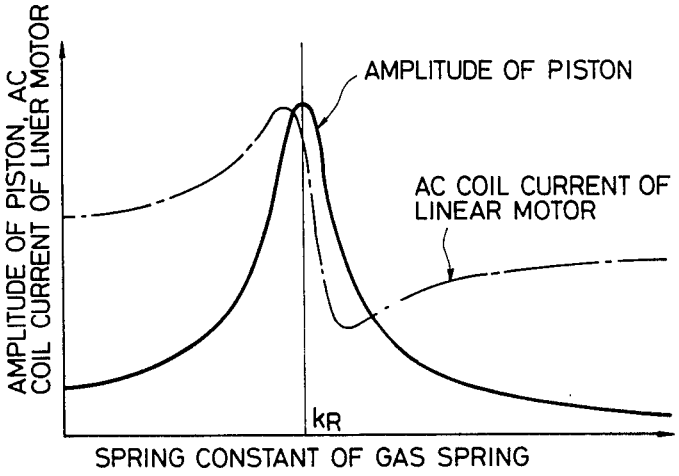
FIG. 4 is a graph showing the oscillation characteristic of the free piston.

Before explaining the circuit of a controller for the piston stroke, the oscillation characteristic of the free piston will be stated. FIG. 4 takes the spring constant of the gas spring on the axis of the abscissas, and indicates the amplitude of the free piston and the current of the linear motor on the axis of the ordinates. In FIG. 4, a solid line denotes the amplitude of the free piston, and a dot-and-dash line denotes the motor current. When the spring constant is $k_R$, the free piston is at maximum amplitude (resonant point). Apart from the resonant point, there are two points where the amplitudes are equal to each other, and the motor current at the point where a spring constant is larger than $k_R$ may be smaller. In order to efficiently operate the compressor, the spring constant of the gas spring must be greater than $k_R$. Since $k_R$ is substantially determined by the mean pressure in the gas spring chambers, the piston stroke control is enabled by the detection of the position of the free piston and the detection of the mean pressure in the gas spring chambers.

Figure 5:
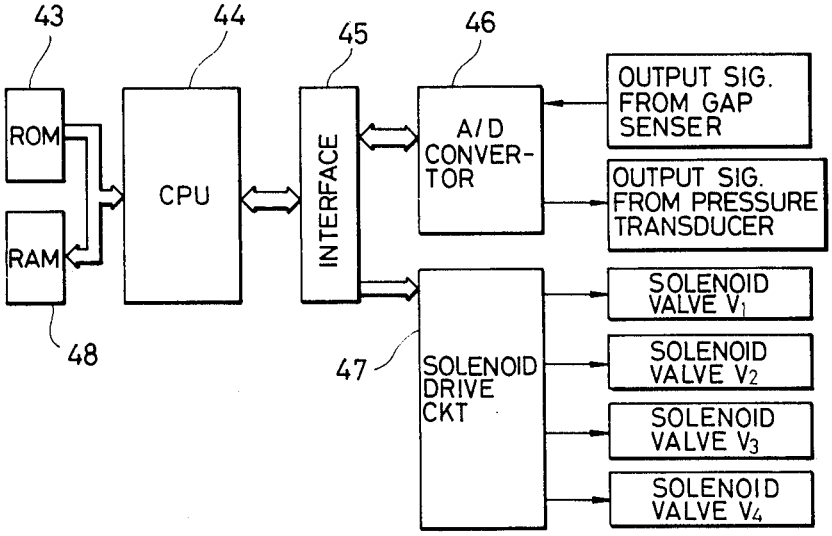
FIG. 5 is a block diagram of a control circuit.

FIG. 5 shows the arrangement of the circuit of a controller. Here will be explained a case where ON-OFF solenoid valves are adopted as the flow control valves and where they are controlled by a microcomputer. A control loop is written into a ROM 43. In accordance with the ROM 43, a CPU 44 receives the output signal S of the gap sensor (the position of the free piston) and the output signal of the pressure transducer (the mean pressure in the gas spring chambers) from an A/D converter 46 through an interface 45. In addition, it turns the solenoid valves $V_1$, $V_2$, $V_3$ and $V_4$ on and off with a solenoid drive circuit 47. Data required in for running the control loop are written in a RAM 48.

Figure 6A:
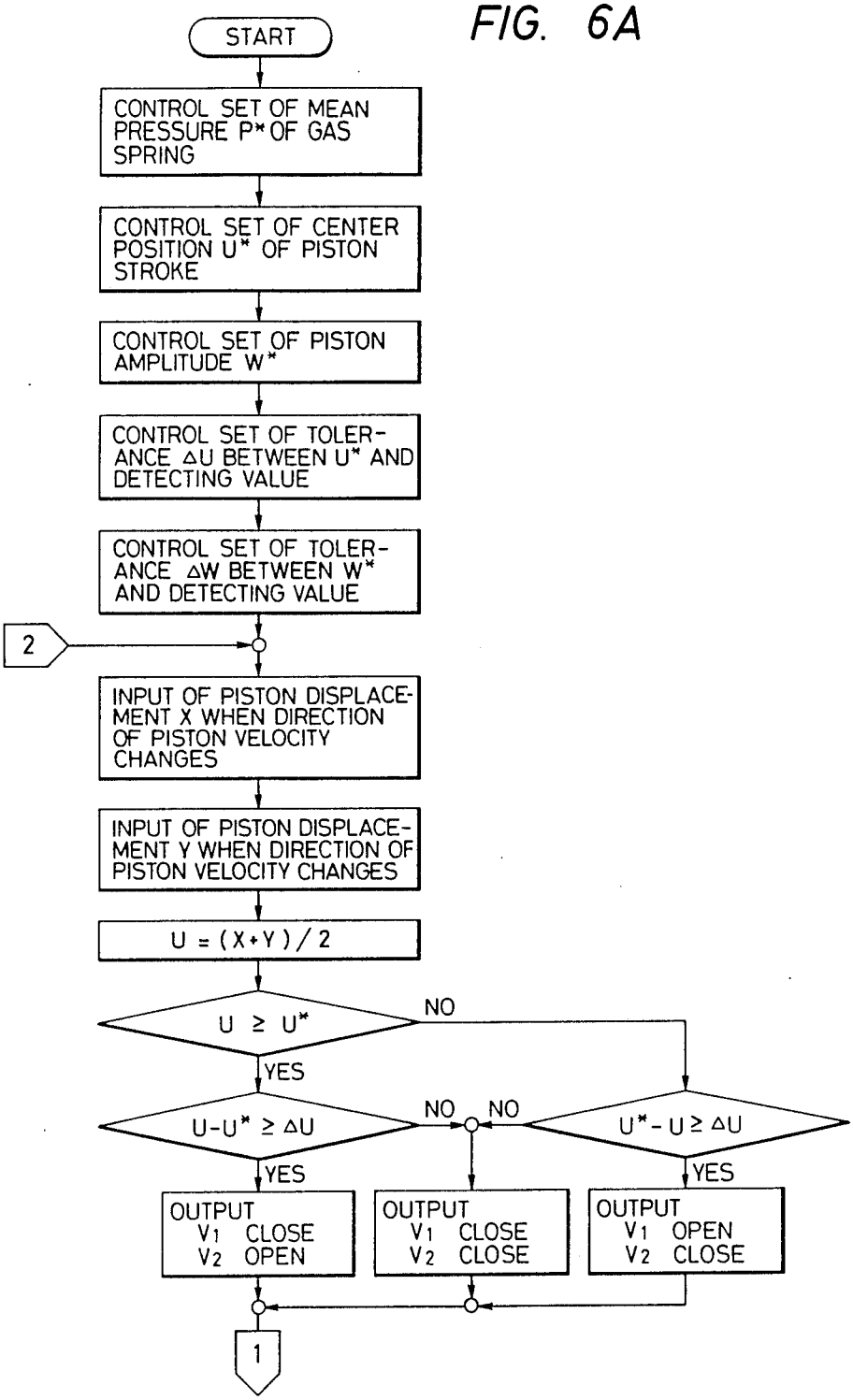
FIGS. 6A and 6B are diagrams showing a control loop.
Figure 6B:
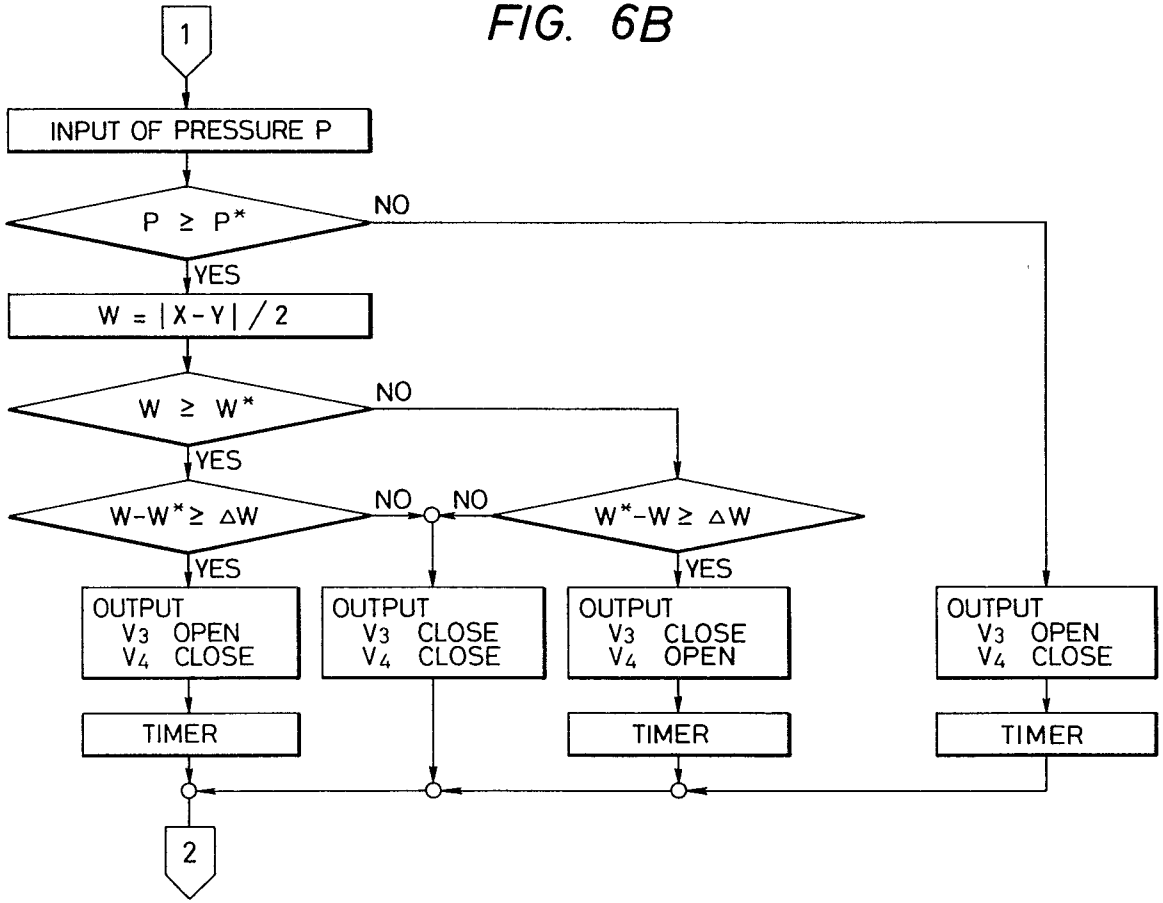

FIGS. 6A and 6B show the control loop. Here, the solenoid valve $V_1$ corresponds to the flow control valve 34 in FIG. 1. Likewise, the valve $V_2$ corresponds to the valve 35, $V_3$ to 36, and $V_4$ to 37. First, the mean pressure $P^*$ of the gas spring chambers at the resonant point, the central position $U^*$ of the stroke of the free piston, the amplitude $W^*$, the control tolerance $\Delta U$ of the central position, and the control tolerance $\Delta W$ of the amplitude are set. Subsequently, piston position X at the time when the direction of piston velocity changes is read, and after a slight pause, piston position Y at the time when the direction of the piston velocity changes is read again. This signifies that the top dead center (or bottom dead center) and the bottom dead center (or top dead center) of the free piston are input. $U=(X+Y)/2$ represents the central position of the stroke of the free piston in operation. Here, the leftward direction is considered the positive direction of the piston displacement. When U is greater than U* by at least the control tolerance $\Delta U$, the solenoid valve $V_1$ is closed and the solenoid valve $V_2$ is opened. Then, the pressure in the pressure space lowers, so that the central position of the stroke of the free piston moves leftwards. When U is less than U* by at least the control tolerance $\Delta U$, the solenoid valve $V_1$ is opened and the solenoid valve $V_2$ is closed. Then, the pressure in the pressure space rises, and the free piston moves rightwards. When the central position of the stroke of the free piston lies within the range of the control tolerance $\Delta U$, both the solenoid valves $V_1$ and $V_2$ are closed. In this way, the central position of the stroke of the free piston can be maintained in the vicinity of the control tolerance range.

Next, the mean pressure P in the gas spring chambers is read. When P is less than P*, the solenoid valve $V_3$ is opened and the solenoid valve $V_4$ is closed. Thus, the spring constant of the gas spring can be maintained so as to be greater than its value at the resonant point at all times. $W=|X-Y|/2$ is calculated. When W is larger than W* by at least the control tolerance $\Delta W$, the solenoid valve $V_3$ is opened and the solenoid valve $V_4$ is closed. Then, the mean pressure of the gas spring chambers rises (the spring constant enlarges), and the amplitude of the free piston decreases as understood from FIG. 4. When W is smaller than W* by at least the control tolerance $\Delta W$, the solenoid valve $V_3$ is closed and the magnetic valve $V_4$ is opened, whereby the amplitude of the free piston can be decreased. When $W-W^*$ lies within the range of the control tolerance $\Delta W$, both the solenoid valves $V_3$ and $V_4$ are closed, whereby the amplitude of the free piston can be maintained in the vicinity of the control tolerance range. An expression 'timer' signifies the ON-OFF time of the magnetic valve, which may be set in consideration of the operating characteristic and durability of the solenoid valve.

What is claimed is:

1. In a free piston type oscillating compressor having a free piston which reciprocates owing to oscillating force of a linear motor, bearings which support the free piston, gas springs which cause the free piston to resonate, and compression chambers; a piston stroke control device for a free piston type oscillating compressor; wherein separate hermatically sealed pressure spaces are provided on each side of said linear motor, and means communicating with said pressure spaces for controlling the pressure of each pressure space and the central position of the stroke of said free piston so as not to deviate to one side.

2. A piston stroke control device for a free piston type oscillating compressor as defined in claim 1, wherein said control means calculates the position of said free piston relative to a cylinder, calculates the central position of the stroke of said free piston from the detected position, compares the calculated result with a desired value (the set value of the central position of the stroke), and feeds a gas from a high pressure source into the hermetically sealed pressure space through a flow control valve or contrariwise discharging the gas of the gastight pressure space to a low pressure source, whereby the pressure of the gastight space is regulated to control the central position of the stroke of said free piston.

3. A piston stroke control device for a free piston type oscillating compressor as defined in claim 2, wherein said control means further detects the mean pressure in the gas spring chamber, feeds the gas from the high pressure source into said gas spring chamber through the flow control valve when the detected pressure is lower than the set pressure and calculates the amplitude of said free piston when the detected mean pressure is higher than the set pressure, and discharges the gas of said gas spring chamber to the low pressure source when the calculated result is smaller than the desired value (the set amplitude) and feeds the gas from the high pressure source into said gas spring chamber when the result is greater than the desired value, to control the amplitude of said free piston.

4. A free piston type oscillating compressor comprising:

a linear motor which includes a motor housing having a stator, and a plunger arranged inside said stator and adapted to reciprocate;

compressors which include pistons mounted on both ends of said plunger of said linear motor and having diameters different from each other, cylinders having bores suited to the diameters of said pistons, and suction and discharge valves mounted on the cylinders;

gas springs which include pistons coupled to the sides of said plunger of said linear motor, cylinders for receiving the corresponding pistons and forming closed gas spring chambers on both sides of said pistons, inlet and outlet passages for the gas into and from said gas spring chambers, and control valves installed in said inlet and outlet passages respectively;

an amplitude/stroke central-position control device which includes pistons coupled to the respective sides of said plunger of said linear motor, cylinders for receiving the corresponding pistons and forming closed spaces, passages for the gas communicating with said closed spaces, control valves arranged in said passages for feeding and discharging the gas, and the circuit of a controller, degrees of opening of said control valves being regulated to control pressures of said closed spaces so as to control a central position of stroke and the amplitude of the pistons of said compressors; and a gap sensor which detects a position of the piston of said compressor.

5. A free piston type oscillating compressor as defined in claim 4, wherein said linear motor is centrally arranged, the two gas springs are arranged on both sides of said linear motor, said closed spaces of said amplitude/stroke-central-position control device are arranged on both the sides of said gas springs, and said compressors are arranged on both the sides of said closed spaces.

6. A free piston type oscillating compressor as defined in claim 4, wherein the bore of the cylinder in said amplitude/stroke-central-position control device is smaller than that of the cylinder of the gas spring and is larger than that of the cylinder of the compressor.

7. A free piston type oscillating compressor as defined in claim 4, wherein partitioned spaces are formed in rod portions of the pistons of the gas springs, and these spaces are held in communication with the corresponding closed spaces of said amplitude/stroke-central-position control device.

8. A free piston type oscillating compressor as defined in claim 4, wherein the position of the piston relative to the cylinder is detected by said gas sensor, and means is provided for calculating the central position of the stroke of the pistons from a signal of the detected position, and comparing the calculated result with the set value of the central position of oscillation so as to regulate said control valves installed in said inlet and outlet passages.

9. A free piston type oscillating compressor as defined in claim 4, comprising a detector which detects the mean pressure of the gas spring chamber, the control being executed so as to open the control valve for feeding the gas for the gas spring when the detected mean pressure is lower than a set value and to open the control valve for discharging the gas when the detected pressure is higher.

10. A free piston type oscillating compressor as defined in claim 6, wherein said cylinders are held in communication so that the gas discharged from the cylinder of smaller bore may be fed into the cylinder of a larger bore.

* * * * *